US005085068A

United States Patent [19]

Rhoades et al.

[11] Patent Number: 5,085,068

[45] Date of Patent: Feb. 4, 1992

[54] DIE FORMING METALLIC SHEET MATERIALS

[75] Inventors: Michael L. Rhoades; Lawrence J. Rhoades, both of Pittsburgh, Pa.

[73] Assignee: Extrude Hone Corporation, Irwin, Pa.

[21] Appl. No.: 734,764

[22] Filed: Jul. 23, 1991

Related U.S. Application Data

[63] Continuation-in-part of Ser. No. 641,773, Jan. 16, 1991.

[51] Int. Cl.[5] ..... B21D 26/02

[52] U.S. Cl. ..... 72/60; 72/54; 72/56

[58] Field of Search ..... 72/54, 56, 57, 60, 63; 29/421.1

[56] References Cited

U.S. PATENT DOCUMENTS

| | | | |
|---|---|---|---|
| 1,625,914 | 4/1927 | Seibt | 72/56 |
| 3,529,458 | 9/1970 | Butler et al. | 72/60 |
| 4,502,309 | 3/1985 | Hamilton et al. | 72/60 |
| 4,934,441 | 1/1976 | Hamilton et al. | 72/60 |

FOREIGN PATENT DOCUMENTS

| | | | |
|---|---|---|---|
| 0056737 | 5/1981 | Japan | 72/54 |
| 0140328 | 6/1986 | Japan | 72/60 |
| 1268247 | 11/1986 | U.S.S.R. | 72/60 |

*Primary Examiner*—David Jones
*Attorney, Agent, or Firm*—Waldron & Associates

[57] ABSTRACT

A process and apparatus for forming a sheet material by drawing it into a die cavity (12) utilizing the flow of a viscous thermoplastic polymer medium extruded against the sheet (22) and/or extruded out of said die cavity (12) through a plurality of passageways, (14*a*), (14*b*), and (14*c*) and programmably varying said extrusion of said medium to cause the sheet material to be controllably stretched into the cavity and shaped.

7 Claims, 3 Drawing Sheets

DIE FORMING METALLIC SHEET MATERIALS

This application is a Continuation-in-Part of Applicants' co-pending application, Ser. No. 07/641,773, filed Jan. 16, 1991, entitled METHOD AND APPARATUS FOR DIE FORMING SHEET MATERIALS.

BACKGROUND OF THE INVENTION

This invention relates to a method and apparatus for die forming sheet materials and particularly sheet metals such as aluminum, titanium, and steel by utilizing a flowable, viscous thermoplastic polymer medium to force the sheet material into a die cavity to generally assume the shape of the cavity surface. This invention finds particular utility in the die forming of sheet metals into complex forms and the die forming of hard-to-work sheet metals.

SUMMARY OF THE PRIOR ART

There are several well known methods for forming cold sheet metal into various configurations, such as embossing, coining, die forming, deep drawing, stretch forming, spinning, and others. Most of these processes utilize some form of punch and die, whereby the punch forcibly presses the sheet metal blank into or through a die to plastically deform the sheet metal into a configuration of the surface of the die cavity, punch surface, or both. In embossing, for example, the punch and die have mating irregular surfaces so that the punch, pressing the sheet metal against the die, will simply bend the sheet metal into the irregular cavity between the punch and die. Coining is quite similar except that the punch surface and die cavity do not mate. The sheet metal is not bent, but caused to flow into the cavities in both the punch and die. These processes are limited to rather small degrees of deformation, yielding a finished product which is still somewhat flat, such as a coin or a spoon.

Conventional die forming is similar to embossing except that the overall shape and configuration of the workpiece is usually significantly altered. In this operation, the sheet material is pressed between two mating dies which stretch the workpiece into the configuration between the two dies, which may resemble bowl or saucer-like configurations, and is a common technique for forming automobile body parts such as side panels and fenders.

Deep drawing, on the other hand, is a process capable of producing rather severe degrees of deformation, whereby products such as two-piece beer and soda cans, washing machine tubs, and the like are formed cold from flat sheet steel or aluminum blanks. In the manufacture of cup shaped products such as engine oil pans and the two piece beer and soda cans, for example, the sheet metal blank is clamped down tight over a die, which merely consists of a hole through a heavy steel plate with rounded corners at the upper surface of the hole. The punch, typically having a flat bottom with rounded edges at the periphery, is driven down through the die, pushing and stretching the sheet metal through the narrow clearance between the sides of the punch and die. The finished product will have a configuration substantially as defined by the punch. Since the edges of the blank are clamped down tight before the draw, the tendency for the sides of the cup to wrinkle is greatly minimized. Often times in order to effect exceptionally deep draws, it is necessary to perform a plurality of separate deep draws so that the metal can be annealed between draws. Further cold shaping may subsequently be effected as necessary to achieve a desired end product; for example, necking the top portion of the beer or soda cans.

It should be apparent that the metal undergoes rather severe deformation during a deep drawing operation. Little or no stretching occurs directly under the flat bottom face of the punch, while the metal is always thinned significantly where it contacts the rounded lower corners of the die. Because a progressively bigger circumferential surface of the sheet metal is progressively being drawn between the punch and die as the metal is drawn, the side walls of the drawn product may tend to wrinkle or develop an eared shell. In addition to the fact that the sheet metal blank is clamped tightly over the die, wrinkling and earing can be minimized, if not avoided, by proper design of the punch and die and use of metals having the proper drawing properties. In this event, the wall thickness near the top of the drawn product is usually thicker than was the starting sheet metal blank.

The above-mentioned variable wall thickness can be avoided in a modified process known as "draw and iron." In this process, the only significant difference from deep drawing is the fact that the clearance between the sides of the punch and die is narrower than the thickness of the sheet metal. When the metal sheet is drawn through the die the sides of the product are "ironed" between the two surfaces to a uniform thickness as it is pulled through the narrow clearance.

Because of the excessive forces exerted on the sheet metal blank, deep drawing equipment must be carefully designed in consideration of the ductility and drawing properties of the metal to be drawn. Particular attention must be focused on the forces exerted on the metal blank as it is stretched around the rounded corner at the lower edge of the punch. The curved edges must be properly radiused and lubricated in order to prevent the force of the punch from tearing the sheet metal blank. Because of limitations in the ductility and drawability of the metal, it is often necessary to provide a plurality of draws so that the incompletely drawn product can be annealed, permitting further drawing. In addition to these limitations there are others which complicate the design of a deep drawing process. For example, the punch must of course be capable of being withdrawn from the drawn product; and accordingly, the diameter of the draw cup cannot be greater at the bottom than it is at top. In addition, undercut impressions cannot be made and bottom surfaces other that flat surfaces are difficult to achieve except by way of incorporating additional deforming steps on the drawn product. The addition of more processing steps merely adds to the equipment cost and time to finish the end product.

Seibt, U.S. Pat. No. 1,625,914 teaches die forming thin metal foils by applying air pressure to deform the sheet into conformity with a female die.

Butler, et.al., U.S. Pat. No. 3,529,458, teach superplastic die forming at elevated temperature, by applying air pressure, among other techniques, to press the sheet into the die cavity.

Hamilton, et.al., U.S. Pat. No. 3,934,441 is directed to superplastic die forming of titanium at temperatures in the range of 1450° to 1850° F.; the reference employs a pressure differential which may be produced by a vacuum between the titanium sheet and the die and may be supplemented by an inert gas on the opposite face of the sheet.

Hamilton, et.al., U.S. Pat. No. 4,502,304 teaches a variety of features of superplastic die forming, and particularly the removal of formed parts from dies. The reference employs air or inert gas pressure to deform the heated sheet into a vented die.

Okimoto, JP 61-140328, discloses superplastic die forming employing granular particles of graphite, metal, or ceramic powder as a pressure transmitting medium.

SUMMARY OF THE INVENTION

This invention is predicated upon the development of a new and unique process for drawing or die forming sheet metals and materials, including hard-to-work sheet metals, into unusual and complex shapes which are not normally possible to produce with conventional die forming techniques. In the process of this invention, the sheet workpiece is drawn into a die which does not use a solid punch, but rather utilizes a flowing viscous thermoplastic polymer media with varying flow patterns to programmably stretch the sheet workpiece into a die utilizing differential pressures, differential flow rates, and/or differential flow sequences designed to effect optimum stretching the workpiece without fracture The operation can accordingly be utilized to greatly reduce the frictional forces on the sheet metal and optimize the surface area available for stretching and, thus, permit a greater degree of deformation and deformation control, even permitting the working of hard-to-work alloys and composites which were never before susceptible to any significant stretching operation.

Accordingly, the object of this invention is to provide a process for drawing sheet material blanks into a die cavity utilizing a flowing viscous thermoplastic polymer medium which not only reduces frictional forces acting on the sheet workpiece, but also provides the ability to control and regulate the deformation sequence of the workpiece, permitting the stretch forming of hard-to-work materials and more severe working of the more conventional sheet materials. The process of this invention also permits the easy formation of more complex configurations such as reverse profiles, undercuts, reentrant corners, and more complex surface detail. The process of this invention greatly reduces the tendency to tear the workpiece, and effects a more uniform stretching throughout the sheet workpiece blank. As a result, more severe deformations can be effected in a single draw including unusual shapes and undercuts, which cannot be effected by a single draw by the prior art techniques.

In addition to the above considerations, it is a well known fact that the formability of materials can be enhanced if the deformation is carried out while the material is subjected to a high hydrostatic surface pressure environment. It has been shown, for example, that a hardened steel plate which fractures when bent to an angle of 10 degrees in a conventional bend test, can be bent to an angle of 80 degrees before fracture in the same test when the steel was formed while subjected to a hydrostatic surface pressure of 80,000 psi. While this phenomenon is known, it has not been possible to commercially incorporate means for subjecting a workpiece to such high hydrostatic pressures in a conventional forming apparatus. Since the process of this invention utilizes the force of a thermoplastic polymer medium under considerable pressure as the forming force, the process of this invention further makes it possible to subject the workpiece to high hydrostatic pressures during the deforming operation, permitting the operation to take advantage of the exceptional plasticity of the workpiece material while subjected to such high hydrostatic pressures, and attain a degree of deformation not possible at atmospheric pressure environments.

DESCRIPTION OF THE INVENTION

Figure 1:
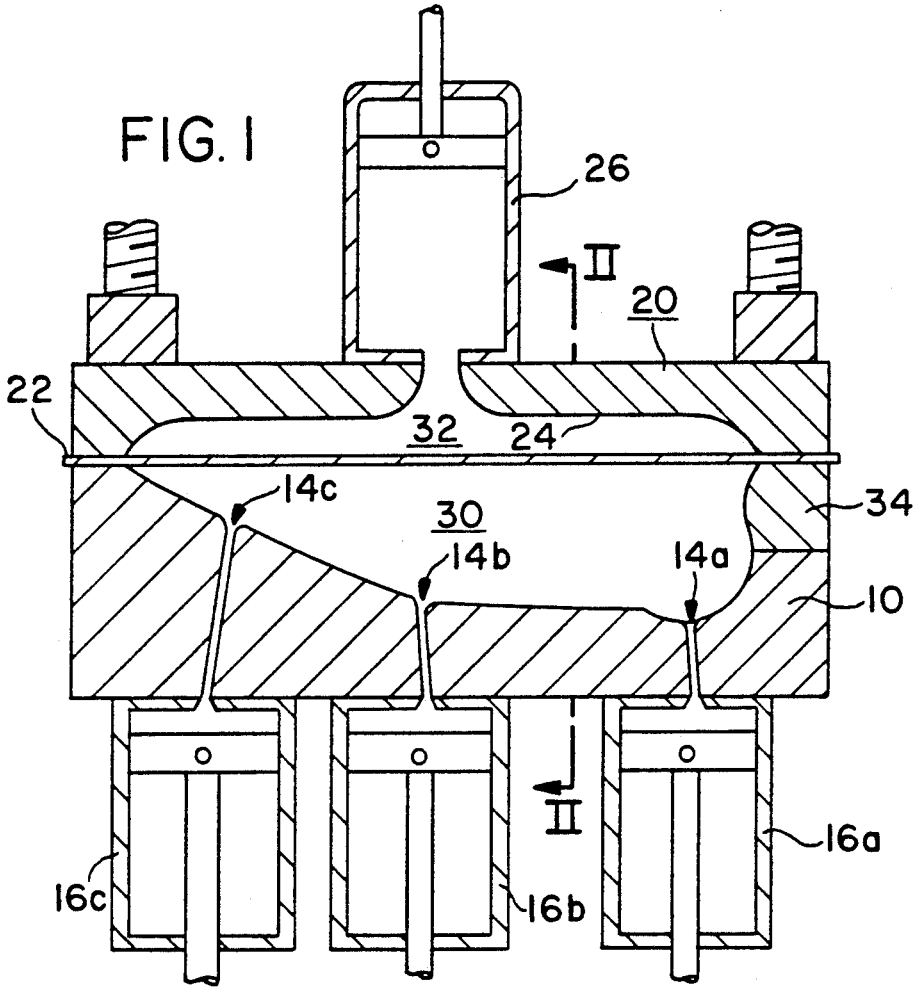
FIG. 1 is a schematic side view of the apparatus of one embodiment of this invention with the die portion shown in section to illustrate the interior prior to a draw.

As shown in FIGS. 1–4, one embodiment of this invention consists of a die (10) having an irregular cavity (12). Three narrow passageways (14*a*), (14*b*), and (14*c*) are provided through the bottom of die (10) extending from the bottom surface of cavity (12) through the body of die (10). Withdrawal cylinders (16*a*), (16*b*), and (16*c*) are connected to the underside of die (10) such that the interior of cylinder (16*a*) communicates with passageways (14*a*), (14*b*), and (14*c*) such that passageways (14*a*), (14*b*), and (14*c*) communicate with cylinders (16*a*), (16*b*), and (16*c*) respectively. Each cylinder (16*a*), (16*b*), and (16*c*) is a thermoplastic polymer extruding, positive displacement, expansible chamber. While the configuration of cavity (12) is not intended to depict any particular product, it illustrates a variety of surface configurations as are capable of being formed in a single operation and could be representative, for example, of an engine oil pan.

A hold-down member (20) is adapted to be clamped tight over the top of die (10) by a means (not shown) such as a clamp or a hydraulic press tightly securing the parts together. While it is generally not preferred, the hold down member (20) may also engage and clamp the edges of a sheet metal blank (22). It is preferred to leave the edges of sheet metal blank (22) unsecured to avoid the stress concentrations which result during the drawing operation. Hold-down member (20) consists of a heavy metal body having a shallow cavity (24) in the underside surface which covers the same area as the upper end of cavity (12) in die (10), and accordingly mates therewith. An injection cylinder (26), being another thermoplastic polymer extruding, positive displacement, expansible chamber, is secured to the top of hold-down member (20) such that the interior communicates with cavity (24) via passageway (28). Means (not shown) must be provided to activate all the cylinders individually and selectively by mechanical or hydraulic operation.

Passageway (28) may be of any size sufficient to pass the viscous thermoplastic polymer medium as desired without unacceptable energy loss. Passageways (14*a*), (14*b*), and (14*c*) should be large enough to allow the viscous thermoplastic polymer medium to flow at a rate corresponding to the programmed retraction of receiving cylinders (16*a*), (16*b*), and (16*c*), but should be small enough to permit the die bottom surface of cavity (12) to support the formed sheet without any significant stretching of the sheet into the passageways.

In operation, a viscous thermoplastic polymer medium (30) is placed within cavity (12), filling the cavity to its upper surface. A like thermoplastic polymer medium (32) is provided within cylinder (26), cavity (24), and passageway (28). A sheet metal blank (22) is then placed over die (10) and thereafter, hold-down member (20) is clamped down onto die (10) by means (not shown), securely holding the mating surfaces in place. In the alternative, it is possible to place the sheet metal over an empty die cavity, and then draw the thermoplastic polymer medium into the cavity by evacuating air through an air bleed vent (not shown).

To commence the drawing process in the embodiment shown, cylinders (26) and (16*a*) are activated in unison so that cylinder (26) will inject thermoplastic polymer medium (32) into cavity (24) while cylinder 16*a* withdraws thermoplastic polymer medium (30) from cavity (12) at the same rate. At this stage, cylinders (16*b*) and (16*c*) are not activated so that the forces acting to stretch sheet metal blank into cavity (12) are not uniform across the top of cavity (12). That is to say, since the only active cylinder withdrawing thermoplastic polymer medium (30) from cavity (12) is on the right side of the cavity, (as viewed in the drawings) the forces acting to stretch the sheet metal blank (22) into cavity (12) are naturally acting on the right side of cavity (12). The active cylinders are graphically illustrated in FIG. 3 by the arrows in cylinders (16*a*) and (26), while zeros are shown in cylinders (16*b*) and (16*c*), indicating that they are not yet active at this point in the operation.

To assist in understanding the above-described phenomenon, it should be realized that the thermoplastic polymer medium of sufficient viscosity will not act in a distinctly non-Newtonian fluid. The ingress or egress of the thermoplastic polymer medium into or out of a cavity as described above will not cause an increase or decrease in medium pressure uniformly throughout the chamber. Rather, the ingress or egress of the thermoplastic polymer medium from a localized point or area will cause motion of the thermoplastic polymer medium in that localized area and thus, will effect a greater change in pressure differential acting on the workpiece in the vicinity of the point of ingress or egress. Conversely, if a Newtonian fluid, i.e., a liquid or a gas, were utilized in the process of this invention, the points of fluid ingress or egress would not be significant since such ingress or egress anywhere in the system would change the system flow patterns substantially uniformly, and controlled deformation of the workpiece could not be effected.

After a considerable portion of stretching or drawing has been effected into the right side of the cavity, cylinder (16*b*) is activated, and will start withdrawing thermoplastic polymer medium (30) from the center portion of the cavity (12), and accordingly start stretching the sheet metal blank (22) towards the center portion of cavity (12) while the right side continues to draw and stretch. At this stage, cylinders (16*a*) and (16*b*) must be withdrawing thermoplastic polymer medium (30) from the cavity (12) at a combined rate equal to the rate at which cylinder (26) is extruding thermoplastic polymer medium (32) into cavity (24). This change in operation will stretch and draw the sheet metal blank (22) across the bottom of cavity (12), increasingly toward the center of the cavity. The thermoplastic polymer medium (32) will exert pressure in all directions and will accordingly stretch the sheet metal into undercut portions of cavity (12), as shown at the undercut location (34). If such an undercut portion is provided in the die cavity, the die will have to be made with a separable piece; e.g., piece (10*a*) so that such a piece can be removed to permit removal of the drawn product after it is formed.

Figure 4:
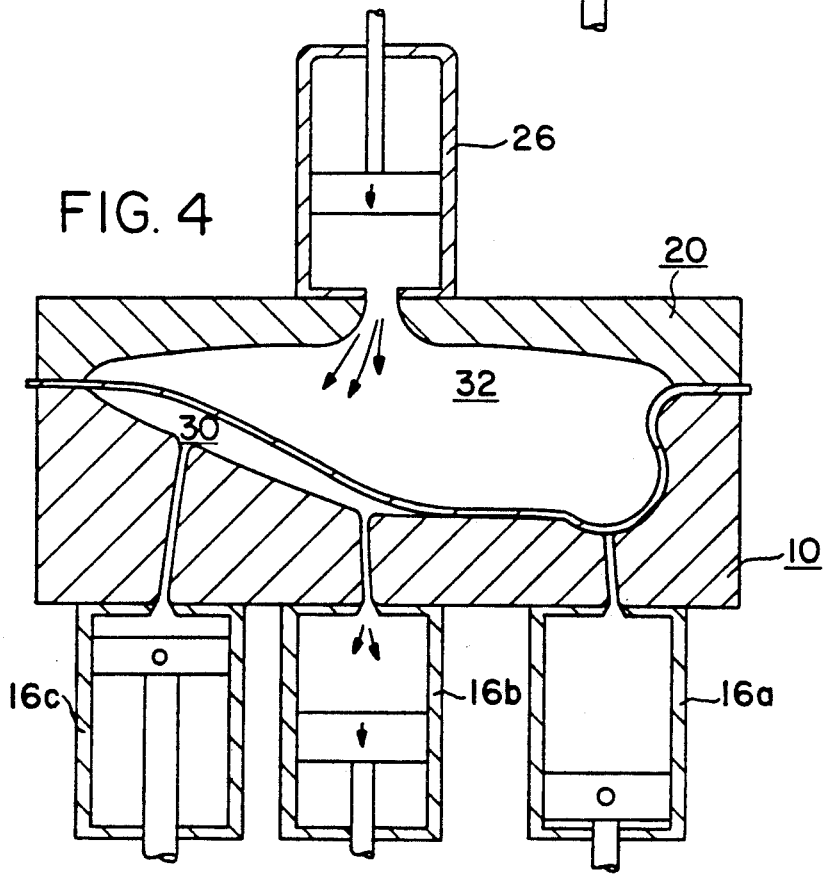
FIG. 4 is identical to FIG. 3 except that it illustrates the interior of the die section as the drawing operation has progressed even further.
Figure 5:
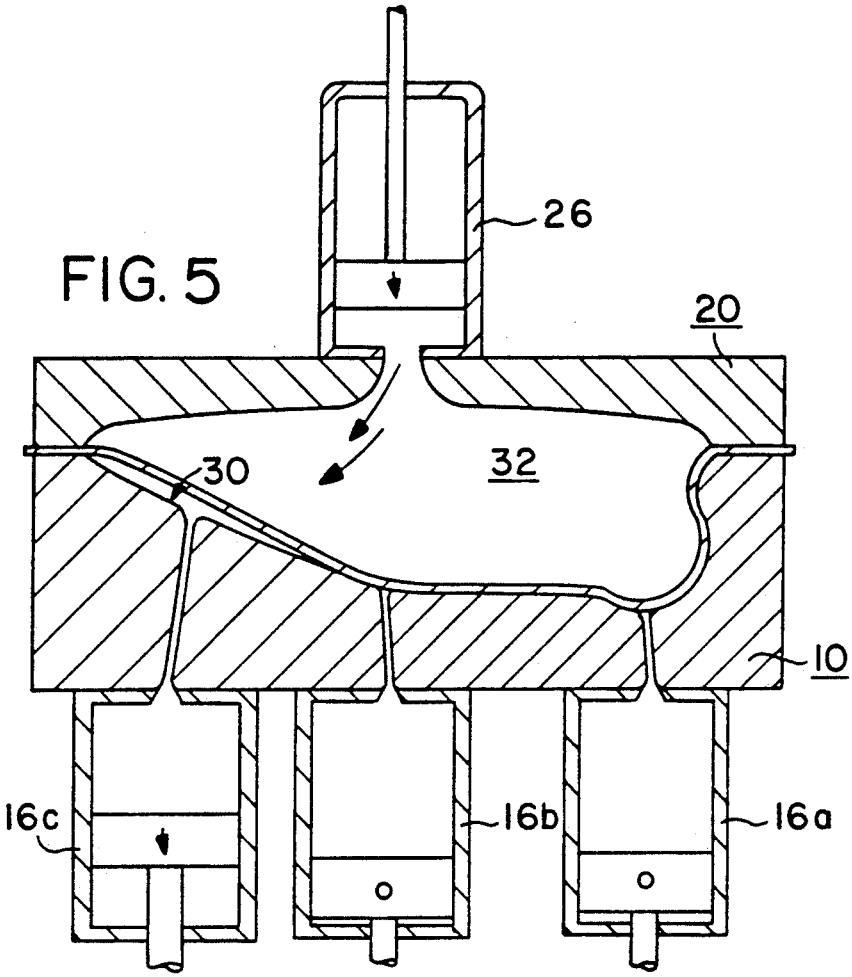
FIG. 5 is identical to FIG. 4 except that it illustrates the interior of the die section just before the drawing operation is completed.

When the sheet metal blank (22) is fully stretched into the lower right side of the cavity, as illustrated in FIG. 4, cylinder (16*a*) is deactivated and cylinder (16*c*) activated. This will start withdrawing thermoplastic polymer medium (30) from the left side of the cavity and accordingly, stretching the sheet metal blank (22) towards the left. As before, cylinders (16*b*) and (16*c*) must withdraw thermoplastic polymer medium (30) at the same rate at which cylinder (26) is extruding thermoplastic polymer medium (32) into cavity (24). When the sheet metal blank (22) has been shaped as necessary into the bottom of cavity (12) over passageway (14*b*), cylinder (16*b*) is inactivated while cylinder (16*c*) continues alone to withdraw thermoplastic polymer medium (30) until the sheet metal is fully formed against cavity (12) as desired on the left side. At this point, the drawing operation is complete, and the hold-down member (20) is removed from the die (10). The drawn sheet metal form is then removed from the cavity (12), and the thermoplastic polymer medium (32) is removed.

As an alternative to the above described embodiment wherein the sequence of medium withdrawal is varied from one port to the next, a similar result can be effected by simultaneously withdrawing the medium through all of the outlet ports, but at varying withdrawal rates. For example, the above sequence of workpiece deformation can be effected by simultaneously withdrawing medium (30) through all three outlet passageways (14*a*), (14*b*) and (14*c*), but at first utilizing a greater withdrawal rate through passageway (14*a*) and subsequently increasing the withdrawal rate through passageway (14*b*), and so on.

As for the thermoplastic polymer medium, there is no particularly critical limitation in the selection of suitable materials, provided the medium is one that has a high viscosity, sufficient to provide a significant pressure differential between the areas adjacent to the passageways (16) and elsewhere in the cavity. If the medium is too fluid there will be little control of the pressure differential within the mold cavity, with little or no ability to control the stretching of the workpiece. In addition, a medium that exhibits an apparent increase in viscosity under shear has some advantage because it provides a more desirable flow distribution.

Polysiloxanes, particularly borosiloxane polymers, are generally preferred, in that they show apparent increasing viscosity with applied shear, do not adhere to most metals, are readily cleaned from the formed surfaces, and have readily controllable viscosities which may be adjusted with the addition of plasticising amounts of polysilanes (silicone oils) or stiffening amounts of fillers, such as silica, diatomaceous earth, zeolites, and the like. Viscosity is also responsive to temperature, of course. Other thermoplastic polymers may be employed, such as low molecular weight addition polymers, including, for example, polyolefins, i.e., polyethylene, polypropylene, polybutene, and the like, polyethers, such as polyethylene oxides, thermoplastic elastomers, including ethylene-propylene copolymers, thermoplastic polyurethanes, and the like.

Figure 6:
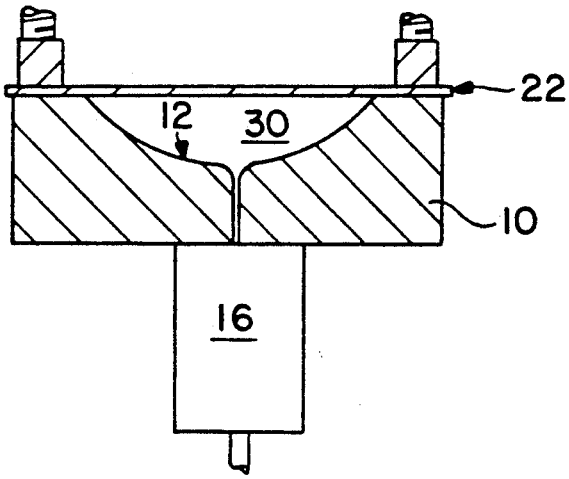
FIG. 6 is a schematic side view of another embodiment of the apparatus according to this invention illustrating a die cavity where only one outlet passageway is necessary due to the simple nature of the die cavity bottom, and utilizing only the viscous thermoplastic polymer prepositioned in the die cavity.

While the above example is only an illustration of one embodiment of how the process functions, it is illustrative of the versatility of the process. Depending upon the geometry of the form to be drawn and the properties of the sheet metal, the sequence of activating the cylinders (16*a*), (16*b*), and (16*c*) can be varied as desired to effect the sheet metal stretching where desired, and thus avoid over drawing and tearing. For example, in the embodiment shown in FIGS. 1-5, it can be seen that the sheet metal blank must be stretched to a greater degree on the right side of the cavity as illustrated. Accordingly, more uniform stretching can be effected by starting the thermoplastic polymer withdrawal at the right side of the cavity (12) so that a greater span of sheet metal is available for stretching while producing this greater depth. Once the sheet metal has been formed against the side wall of the cavity, as first happens on the right side in the embodiment shown, frictional forces between the sheet metal and the wall of the cavity will prevent further stretching of that body of metal so formed. Hence, the further stretching of sheet metal across the bottom of cavity (12) and into the lower left hand corner will stretch only that portion of sheet metal not yet formed against a cavity wall. It follows that the left wall and bottom of the finished product may be somewhat thinner than the right wall. Had the withdrawal programming been reversed in the above example by starting on the left side where the draw is shallower, there would have been a greater difference in wall thickness from left to right. It is apparent that through proper programming of the medium withdrawal and/or injection, the stretching of the sheet workpiece can be carefully controlled to effect whatever degree of stretching is desired in the various portions of the mold. Where a cavity is reasonably uniform on both sides or around, it would normally be desirable to start the withdrawal of thermoplastic polymer medium from the center of the cavity. In fact, if there are no lower corners to be concerned with, a single withdrawal from the center may be adequate, as depicted in FIG. 6. Since there is little frictional force between the thermoplastic polymer medium and sheet metal, as there is at the interface between a conventional punch and the sheet metal, the ideal sequence of media withdrawal from the cavity would be to stretch as much of the sheet metal as possible into the cavity before it is formed against a cavity side wall. Accordingly, a far more uniform stretching can be effected by this process.

Figure 2:
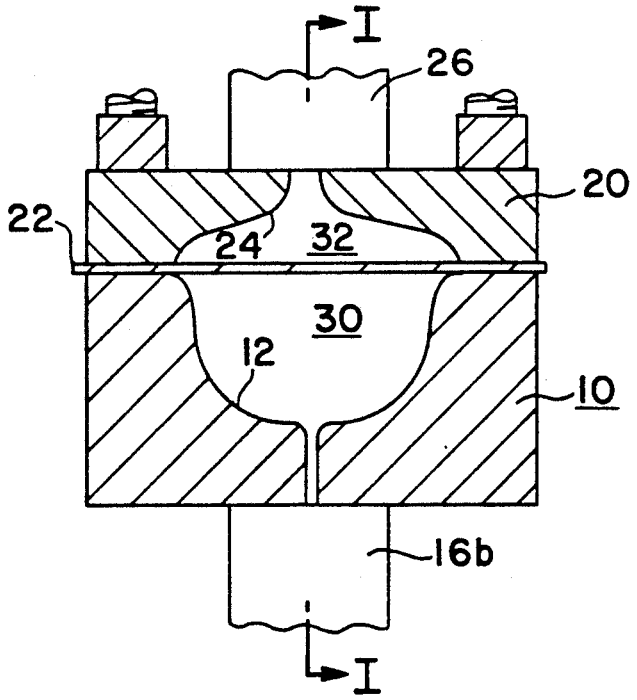
FIG. 2 is a cross-section of the arrangement shown in FIG. 1 taken at line II—II.
Figure 3:
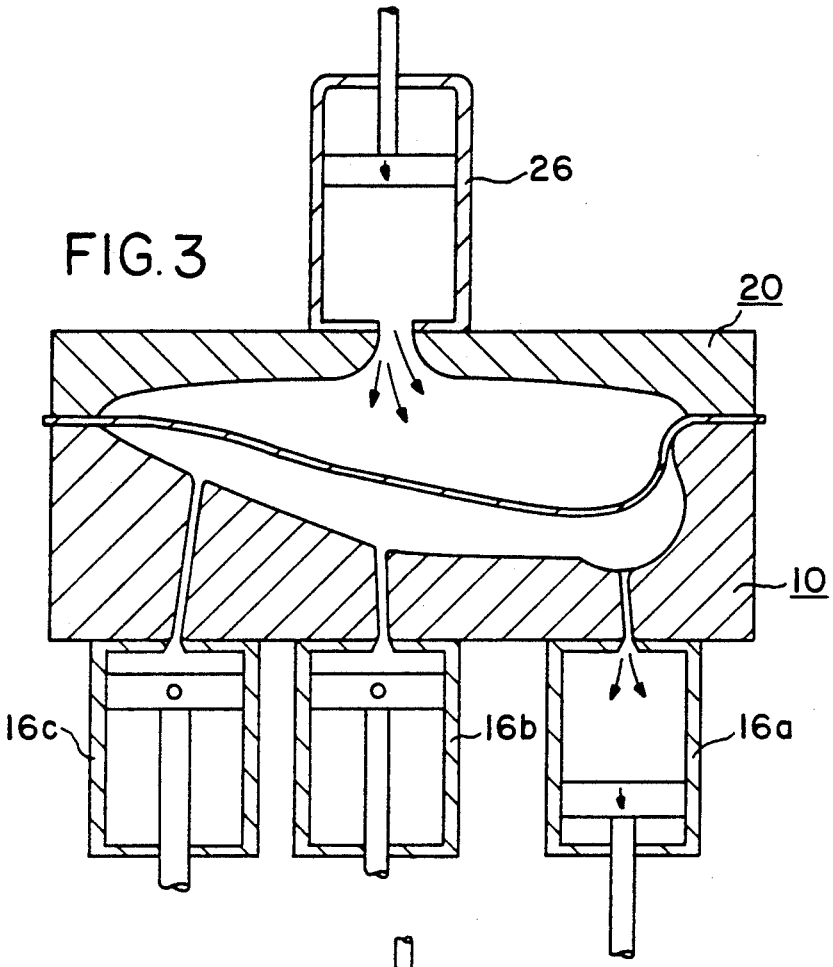
FIG. 3 is a identical to FIG. 1 except that it illustrates the interior of the die section shortly after the drawing operation has been commenced.

The actual number of outlet passageways necessary from the die cavity may vary considerably depending upon the nature of the cavity itself and the degree of control desired in withdrawing the viscous thermoplastic polymer medium. If the bottom of the die cavity consists of a large horizontal flat surface, it may be necessary to provide a rather large number of outlet passageways to assure that no thermoplastic polymer medium becomes entrapped between the die surface and the sheet metal to effect a distorted drawn configuration. It should be noted that the embodiment shown in FIGS. 1-5 utilizes only three outlet passageways (14), primarily because the bottom is narrow, as shown in FIG. 2, and has considerable sloping which facilitates withdrawal of the thermoplastic polymer medium without any significant possibility of entrapping the medium within the cavity. If the width dimension of the die as shown in FIG. 2 were wider and/or the bottom flatter, then two or possibly more outlet passageways would have to be provided across the width at each location (14*a*), (14*b*), and (14*c*) to assure complete withdrawal of the medium from the cavity. FIG. 6, on the other hand, illustrates a situation where only one outlet passageway is adequate.

While only one inlet cylinder (26) and passageway (28) is shown in the embodiment of FIGS. 1-5, it should be obvious that a plurality of inlet passageways (28) with associated cylinders (26) can be provided where necessary or desirable to better control the stretching of the sheet metal workpiece and where the design of the mold cavity warrants it. For some applications it may be desirable to provide a plurality of injection passageways with only one withdrawal passageway, or possibly even utilizing no withdrawal of medium whereby only the injected medium deforms the sheet metal. By selectively programming either one or both the inlet medium and outlet medium through the various passageways simultaneously at differential rates among the injecting and withdrawing cylinders, the sheet metal workpiece can be controllably stretched into the mold cavity in practically any sequence desired. This will provide a great degree of flexibility of results to provide a uniform or controlled nonuniform wall thickness.

In addition to the above considerations which are addressed to the detailed process as exemplified, numerous other modifications and embodiments could be utilized to advantage depending upon the product to be produced and the sheet metal utilized. For example, any number of passageways (14) and associated cylinders (16) can be provided depending on the size and geometry of cavity (12). For shallow, reasonably uniform cavities, just one passageway (14) and cylinder (16) may be adequate. Such a situation is illustrated in FIG. 6.

It should also be realized that in those applications utilizing multiple passageways (14) and cylinders (16), it will not always be necessary to withdraw the thermoplastic polymer medium (30) sequentially from cavity (12), provided that a uniform stretching of the sheet metal can be effected without such a sequential withdrawal. Placement of the cylinders with respect to die (10) and hold-down member (20), or connected parts, may also be varied provided they do not interfere with the cavities.

In applications where hard-to-work metals are utilized, the above-discussed advantages of the inventive process will permit the deformation of the metal to a greater extent than prior art processes because the entire sheet surface area over the die cavity is subject to stretching. In addition the pressures of the two media can be elevated to the point where the workpiece is subjected to a considerable hydrostatic surface pressure sufficient to render the material susceptible to exceptional plasticity, as discussed above. In such circumstances, even the hard-to-work metals can be subjected to exceptional degrees of deformation without risk of tearing or fracture of the workpiece.

In still other embodiments it may not be necessary to provide a thermoplastic polymer medium acting on both surfaces of the sheet metal. For example, when the sheet metal has a high degree of ductility and/or the draw depth is reasonably shallow, the upper media (32) can be dispensed with, allowing the atmospheric air pressure to stretch the sheet metal into cavity (12) as the thermoplastic polymer medium (30) is programmably withdrawn from cavity (12). In the alternative, the reverse can be utilized whereby only the upper incoming medium is utilized to stretch the sheet metal into an empty die cavity. An example of this situation is illustrated in FIG. 6 where the die cavity is rather shallow. In this embodiment, the die cavity must be vented, to ambient or vacuum, and at least two passages for differential and programmed introduction of the medium into the high pressure cavity, i.e., above the sheet as shown in FIG. 6. It should be apparent that numerous other embodiments and modifications could be utilized or incorporated without departing from the spirit of this invention.

In view of the above discussion, it should be apparent that the possible variations and embodiments of this invention are quite flexible and variable in permitting one to draw a sheet workpiece into a die, stretching and drawing the sheet in any desired sequence and direction as necessary to optimize its drawability and conformation to the die.

While the above process has been described as applied to the forming of sheet metal blanks, it should be further apparent that the process could be utilized to draw sheet materials such as thermoplastic polymers.

What is claimed is:

1. The method of die forming metallic sheet materials comprising the steps of:

A. providing a die provided with a cavity and at least one exit port and said cavity filled with a viscous thermoplastic polymer;

B. providing means for withdrawing said polymer from said cavity through said exit port;

C. providing means to fix a metallic sheet in engagement with said die and enclosing said cavity;

D. controllably withdrawing said polymer from said cavity while applying pressure to said sheet on the face opposite said cavity until said sheet is conformed to the shape of said die.

2. The method of claim 1, wherein said die is provided with a plurality of exit ports and said polymer is withdrawn from each said exit port selectively to control flow from said cavity to control the forming of said sheet.

3. The method of claim 1, wherein said cavity is reentrant.

4. The method of claim 1, wherein the withdrawing of said polymer and the applications of pressure to said sheet on the face opposite said cavity are controlled so that said sheet is maintained at elevated hydrostatic pressure.

5. The method of claim 4, wherein said die is provided with a plurality of exit ports and said polymer is withdrawn from each said exit port selectively to control flow from said cavity to control the forming of said sheet.

6. The method of claim 1, wherein pressure is applied to said sheet on the face opposite said cavity by ambient pressure 7. The method of claim 1, wherein pressure is applied to said sheet by means for applying a viscous thermoplastic polymer under pressure

* * * * *